US006705410B2

(12) United States Patent
Ziegler

(10) Patent No.: US 6,705,410 B2
(45) Date of Patent: Mar. 16, 2004

(54) ELECTRICAL HAND-HELD POWER TOOL WITH A SAFETY CLUTCH

(75) Inventor: Bernd Ziegler, Hiltenfingen (DE)

(73) Assignee: Hilti Aktiengesellschaft, Schaan (LI)

( * ) Notice: Subject to any disclaimer, the term of this patent is extended or adjusted under 35 U.S.C. 154(b) by 114 days.

(21) Appl. No.: 10/053,293

(22) Filed: Jan. 23, 2002

(65) Prior Publication Data

US 2002/0062967 A1 May 30, 2002

(30) Foreign Application Priority Data

Nov. 17, 2000 (DE) ..... 100 57 139

(51) Int. Cl.[7] ..... B25D 16/00

(52) U.S. Cl. ..... 173/178; 173/176; 173/201; 173/216; 173/217

(58) Field of Search ..... 173/178, 216, 173/217, 176, 109, 213, 201, 473, 467

(56) References Cited

U.S. PATENT DOCUMENTS 4,346,767 A * 8/1982 Vaughan ..... 173/109
5,209,308 A * 5/1993 Sasaki ..... 173/178
5,343,961 A * 9/1994 Ichikawa ..... 173/178
5,947,210 A * 9/1999 Sasaki et al. ..... 173/216
6,015,017 A * 1/2000 Lauterwald ..... 173/109
6,176,162 B1 * 1/2001 Ludwig et al. ..... 81/473
6,244,358 B1 * 6/2001 Beer et al. ..... 173/178
6,478,095 B2 * 11/2002 Neumaier ..... 173/201

* cited by examiner

*Primary Examiner*—Scott A. Smith
(74) *Attorney, Agent, or Firm*—Sidley Austin Brown & Wood, LLP

(57) ABSTRACT

An electrical hand-held power tool including a pinion (4) for driving a gear set that transmits a rotational movement to a power tool spindle, a pinion shaft (10) for supporting the pinion (4), an electric motor (2) for generating a torque, a rotor shaft (11) connected with the electric motor (2) for transmitting the torque to the pinion shaft (10), and a safety clutch (5) provided between the pinion shaft (10) and the rotor shaft (11), with the pinion shaft being formed as a hollow shaft provided in its interior with inner bearing which rotatably supports the pinion shaft (10), and with the rotor shaft (10) having its end received in the interior of the pinion shaft (10) and supported against the inner bearing.

7 Claims, 2 Drawing Sheets

ELECTRICAL HAND-HELD POWER TOOL WITH A SAFETY CLUTCH

BACKGROUND OF THE INVENTION

1. Field of the Invention

The present invention relates to an electrical hand-held power tool for a rotatable tool and including a safety clutch that at critical operational conditions disconnects the electric motor of the power tool from the power transmitting chain. In particular, the present invention relates to a hammer drill with a safety clutch.

2. Description of the Prior Art

Electrical hand-held power tools such as, e.g., hammer drills, are driven by a rapidly rotating electric motor that, therefore, is provided with a capability to store a large amount of rotational energy due to its angular momentum. To prevent an unpermissible deflection of a hand-operated electrical power tool at critical operational conditions, in particular, when the working tool becomes locked, the drive power must be quickly disconnected, or the power transmission chain between the electric motor and the working tool should be broken sufficiently quickly. In electrical power tools with a large power, the driving power cannot be disconnected sufficiently rapidly without using additional means.

For breaking the power transmission chain, clutches, which are arranged in the transmission chain between the electric motor and the working tool, are used. Usually, the clutches are formed as safety clutches that break the transmission chain when a transmitted torque exceeds a predetermined threshold. The conventionally used clutches are formed as pure mechanical slip clutches such as disclosed in German Publication DE 40 36912, or as electrically controlled, electromagnetic clutches such as disclosed, e.g., in European publication EP 486 842. For power transmission in an engaged condition, coupling elements, which are primarily arranged radially outside of the two coaxial shafts and are frictionally connected with each other, are used.

European publication EP 694 706 discloses a slip clutch that has forcelocking coupling means which is arranged radially outside of two coaxial hollow shafts engaged in each other and which consists of two coupling elements associated with respective shafts and which slide relative to each other when a predetermined adjustable static friction force is exceeded.

In electrical power tools with an electric motor arranged transverse to the working tool axis, a bevel gear set is primarily used for transmitting torque between the axis of the electric motor rotor and the working tool axis. The bevel gear set includes a bevel pinion supported on the rotor shaft, as disclosed in German Utility Model DM-92 08 407, or is arranged parallel to the rotor shaft.

For reducing the dimension of the power tool in a direction transverse to the working tool axis, U.S. Pat. No. 4,346,767 discloses an arrangement of a safety clutch in the power transmission chain. The clutch is offset axially and is structurally integrated in the intermediate stage of the gear set.

The drawbacks of the in-line arranged, safety clutches consist in that they need additional bearings for their support, which should be provided in the power transmitting chain, and an increase of the volume of the power tool housing. Providing more than two support points for a shaft results even with a small displacement, in a disadvantageous tension in the drive chain.

Accordingly, the object the present invention is to provide an electrical hand-held power tool in which the safety clutch is supported directly on a rapidly rotatable rotor shaft, with a minimum increase of the axial dimension of the tool housing.

Another object of the present invention is to provide an electrical hand-held power tool with a safety clutch that would provide for an active braking of the rotor shaft.

SUMMARY OF THE INVENTION

These and other objects of the present invention, which will become apparent hereinafter, are achieved by providing an electrical hand-held power tool in which the pinion shaft is formed as a hollow shaft, and an inner bearing for rotatably supporting the pinion shaft is provided in its interior, and the rotor shaft has its end received in the interior of the pinion shaft and supported against the inner bearing.

The safety clutch is provided between the pinion and rotor shafts and provides for their joint rotation during a normal operation and insures at a critical condition their rotation relative to each other. The rotor shaft engages in the hollow pinion shaft supported for rotation by the inner bearing. The inner bearing is formed as a slide bearing that is centered with respect to the common, with the pinion and rotor shaft, axis by a central ball. The inner bearing is provided with sufficiently long axial slide surfaces which insure a tilt-free absorbtion of the transverse forces applied to the pinion. A radial outer bearing, which is provided in the region of engagement of the rotor shaft in the pinion shaft, supports the rotor shaft and, via the inner bearing, the pinion shaft for rotation in the power tool housing. A rotor bearing provided at an end of the rotor shaft remote from the engagement region absorbs the transverse forces.

Advantageously, the safety clutch is formed as an electromagnetic clutch in which at least the adjacent radially end surfaces of the rotor disc of the clutch supported on the pinion shaft for joint rotation therewith, and of the anchor disc of the clutch rotatably supported on the rotor shaft for joint rotation therewith, are formed of a ferromagnetic material. During a normal operation, a magnetic flux, which is produced by the magnetic coil, causes attraction of the rotor and anchor discs to each other, providing for their form-or forcelocking connection.

Advantageously, the hollow cylindrical magnetic coil, which is mounted on a non-ferromagnetic end plate of the power tool housing, is surrounded at its three free sides by the rotor disc for transmitting magnetic flux thereto. The outer radial bearing, which supports the pinion and the rotor shafts, is arranged within the magnetic coil. As a result of such an arrangement, the outer bearing, the rotor disc, and the magnetic coil are nested within each other in a limited axial region. As a result, only a very insignificant lengthening of the housing is required for the integration of the safety clutch.

During interruption of the power transmission by the electromagnetic clutch, the braked pinion shaft comes relatively rapidly to a standstill as result of fiction forces generated by the working tool and in the gear set. The connection of the relatively light anchor disc with the rotor shaft only insignificantly increases its rotational energy, which result, as usual, in the runout of the electric motor. Advantageously, only after the electric motor comes to a standstill, the electromagnetic clutch is energized again, which prevents an inadvertent power transmission to the working tool.

Advantageously, a friction lining is provided on a surface of a pot-shaped clutch cover which faces the adjacent end surface of the anchor disc. At a critical condition, a spring, which is arranged within the anchor disc and which becomes preloaded by the electromagnetic clutch, biases the anchor disc and friction lining into a frictional contact with each other. The anchor disc provides for braking of the electric motor that comes to standstill, with the rotational energy of the motor being dissipated as a result.

The magnetic coil can be secured to the end plate of the housing and be pre-assembled together with the rotor disc and the pinion shaft. In the next step, the rotor shaft, together with the anchor disc and the housing or clutch cover, which also serves as a dust protector, is pushed into the pinion shaft.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
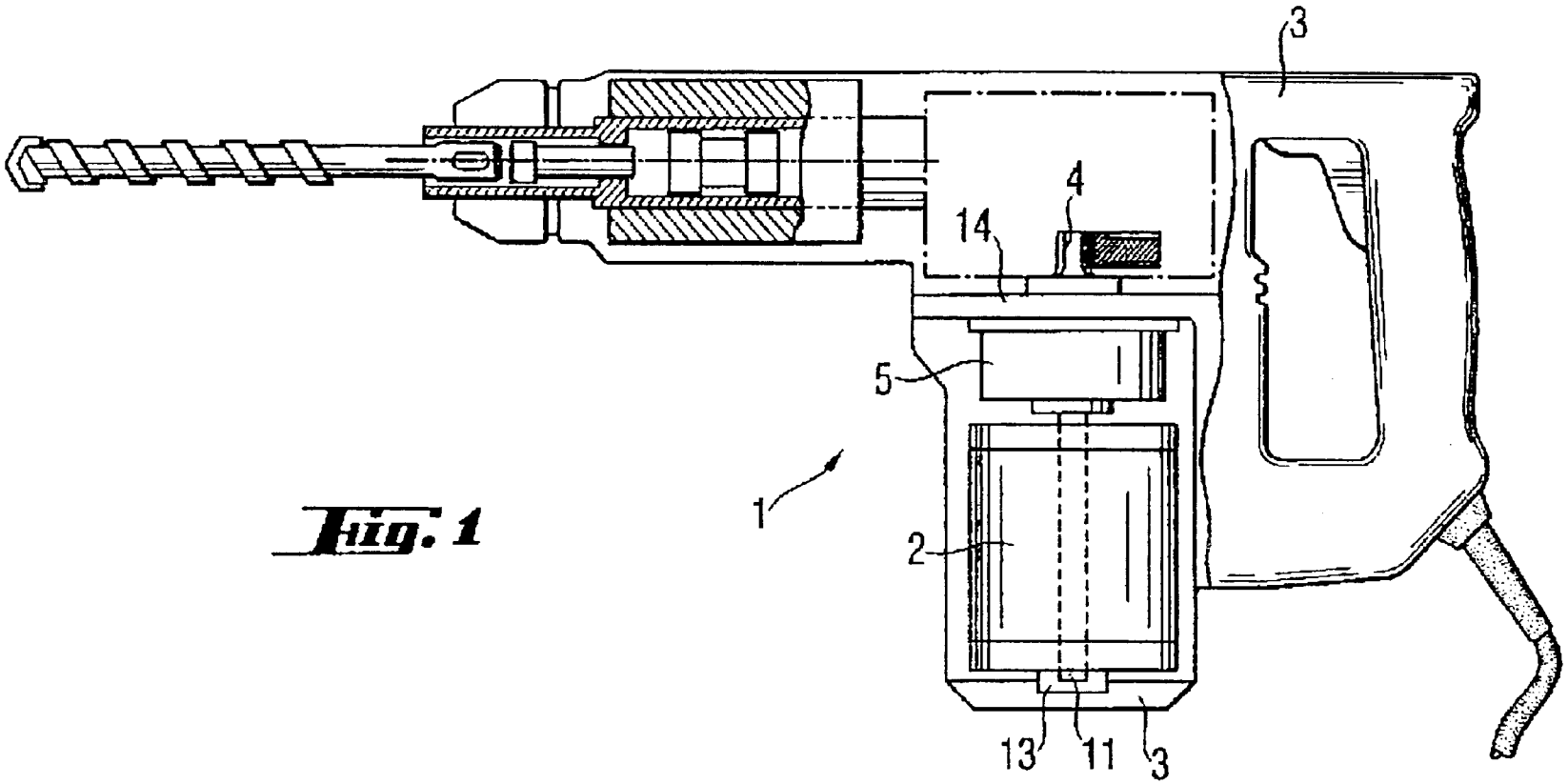
FIG. 1 a side, partially cross-sectional view of an electrical hand-held power tool according to the present invention.

An electrical hand-held power tool 1 according to the present invention, a general view of which is shown in FIG. 1, includes a housing 3, an electric motor 2 located in the housing 3, a first stage of a gear set driven by a spur pinion 4, and a safety clutch 5 located between the pinion 4 and the electric motor 2.

Figure 2:
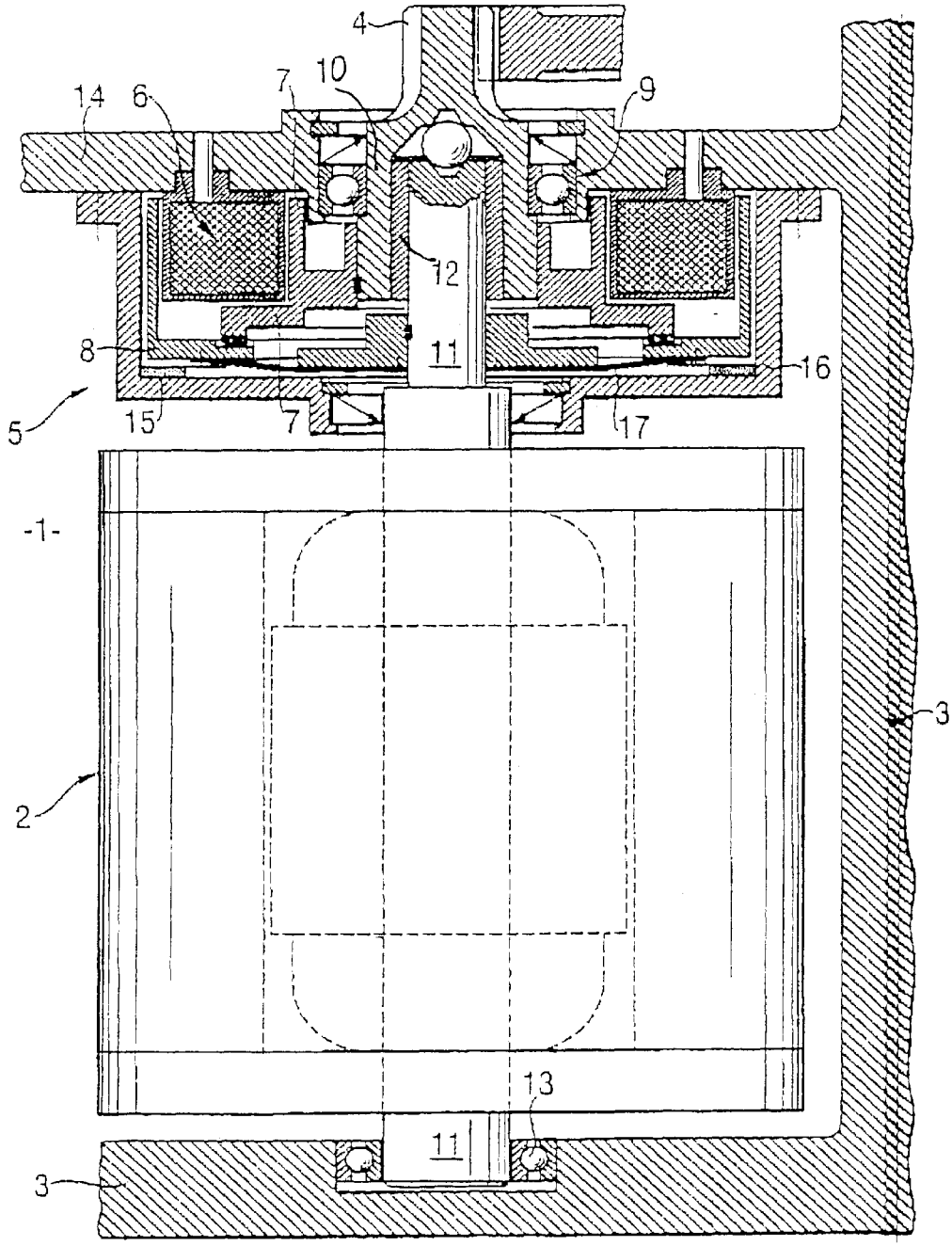
FIG. 2 a transverse cross-sectional view of the electrical hand-held power tool shown in FIG. 1 with a safety clutch shown in detail.

The safety clutch 5, which is shown in detail in FIG. 2, is located in a power transmitting chain from the electric motor 2 to the spur pinion 4. The safety clutch 5 is formed preferably as an electromagnetic clutch with a magnetic coil 6, a driven clutch disc formed as a rotor disc 7, and a driving clutch disc formed as a anchor disc 8. The hollow cylindrical magnetic coil 6 surrounds an outer radial bearing 9 which supports a pinion shaft 10 formed as one-piece with the pinion 4. The pinion shaft 10 is formed as a hollow shaft in which a rotor shaft 11 connected with electric motor 2 is received. The pinion shaft 10 is rotatably supported by an inner bearing 12 formed as a slide bearing which includes a central ball and sufficiently long axial sliding surfaces. The inner bearing 12 is designed for tilt-free absorption of transverse forces acting on the pinion 4. The outer bearing 9 and the inner bearing 12 rotatably support the pinion shaft 10 and the rotor shaft 11 in the housing 3, with the transverse forces being absorbed by a rotor bearing 13 provided at an end of the rotor shaft 11 opposite the rotor shaft 10. At least the adjacent radially outer end surfaces of the rotor disc 7, which is connected with the pinion shaft 10 for joint rotation therewith, and of the anchor disc 8, which is connected with the rotor shaft 11 for joint rotation therewith, are formed of a ferromagnetic material. A magnetic flux, which is produced by the energized magnetic coil 6, provides for attraction of the anchor disc 8 to the rotor disc 7, which become form-or forcelockingly connected with the rotor disc 7.

The hollow magnetic coil 6 is secured in an end plate 14 which serves for mounting of the outer bearing 9 in the housing 3. The magnetic coil 6 is surrounded, at its three free sides, by the rotor disc 7 and the anchor disc 8. As shown in FIG. 2, the outer bearing 9 of the pinion shaft 10 and the rotor shaft 11, the rotor disc 7, and the magnetic coil 6 are nested within each other in a narrow, limited axial region.

As further shown in FIG. 2, a friction lining 15 is provided on a surface 16 of the clutch cover facing the anchor disc 8, in the radially outer region of the surface 16. An axially preloaded spring 17, which is formed as a leaf spring, biases into the friction lining 15 into a friction contact with the end surface of the anchor disc 8 remote from the rotor disc 7.

The clutch cover, together with the anchor disc 8, is secured to the magnetic coil-supporting, end plate 14. The end of the rotor shaft 11 adjacent to the pinion 4 is received in the inner bearing 12 provided in the interior of the pinion shaft 10.

Though the present invention was shown and described with references to the preferred embodiment, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiment within the spirit and scope of the present invention as defined by the appended claims.

What is claimed is:

1. An electrical hand-held power tool, comprising a pinion (4) for driving a gear set that transmits a rotational movement to a power tool spindle; a pinion shaft (10) for supporting the pinion (4); an electric motor (2) for generating a torque; a rotor shaft (11) connected with the electric motor (2) for transmitting the torque to the pinion shaft (10); and a safety clutch (5) provided between the pinion shaft (10) and the rotor shaft (11), wherein the pinion shaft is formed as a hollow shaft, and an inner bearing for rotatably supporting the pinion shaft (10) is provided in an interior thereof;

wherein the rotor shaft (11) has an end thereof received in an interior of the pinion shaft (10) and supported against the inner bearing (12), and wherein the power tool further comprises a rotor disc (7) supported on the pinion shaft (10) for joint rotation therewith, and an anchor disc (8) supported on the rotor shaft (11) for joint rotation therewith.

2. An electrical hand-held power tool according to claim 1, further comprising a radial outer bearing (9) provided in an axial engagement region of the inner bearing (12) with the pinion shaft (10).

3. An electrical hand-held power tool according to claim 2, wherein the safety clutch is formed as an electromagnetic clutch.

4. An electrical hand-held power tool according to claim 3, wherein the electromagnetic clutch comprises a hollow magnetic coil (6) in an interior of which the outer bearing (9) is located.

5. An electrical hand-held power tool according to claim 4, further comprising an end plate (14) for supporting the outer bearing (9), the magnetic coil (6) being secured in the end plate (14).

6. An electrical hand-held power tool according to claim 1, wherein the inner bearing 12 is formed as a slide bearing having an axial extent corresponding to an axial extent of the pinion shaft.

7. An electrical hand-held power tool according to claim 1, further comprising a friction lining (15) provided at a radially outer region of and end surface of the anchor disc (8) remote from the rotor disc (7).

* * * * *